US011350675B2

(12) United States Patent
Riehlman et al.

(10) Patent No.: US 11,350,675 B2
(45) Date of Patent: Jun. 7, 2022

(54) VAPE COIL CLEANING DEVICE

(71) Applicants: Mary Beth Riehlman, Green Cove Springs, FL (US); Terry Anne Bocklet, South Salem, NY (US); Michael J. Logan, Syracuse, NY (US); Fred A. Marconi, Jr., Erieville, NY (US)

(72) Inventors: Mary Beth Riehlman, Green Cove Springs, FL (US); Terry Anne Bocklet, South Salem, NY (US); Michael J. Logan, Syracuse, NY (US); Fred A. Marconi, Jr., Erieville, NY (US)

( * ) Notice: Subject to any disclaimer, the term of this patent is extended or adjusted under 35 U.S.C. 154(b) by 277 days.

(21) Appl. No.: 16/702,807

(22) Filed: Dec. 4, 2019

(65) Prior Publication Data

US 2021/0169149 A1 Jun. 10, 2021

(51) Int. Cl.

| | |
|---|---|
| ***A24F 40/85*** | (2020.01) |
| ***B08B 7/00*** | (2006.01) |
| *A24F 40/44* | (2020.01) |

(52) U.S. Cl.

CPC ..... *A24F 40/85* (2020.01); *B08B 7/0071* (2013.01); *A24F 40/44* (2020.01)

(58) Field of Classification Search

CPC ..... A24F 40/85
USPC ..... 131/244
See application file for complete search history.

(56) References Cited

U.S. PATENT DOCUMENTS 4,250,630 A * 2/1981 Moses ..... A24F 9/14 131/244
2021/0307409 A1* 10/2021 Lee ..... A24F 40/85

FOREIGN PATENT DOCUMENTS

GB 152471 A * 10/1920 ..... A24F 9/12

* cited by examiner

*Primary Examiner* — Kelly M Gambetta
*Assistant Examiner* — Russell E Sparks
(74) *Attorney, Agent, or Firm* — Bond Schoeneck and King PLLC; David Nocilly

(57) ABSTRACT

A vape cleaning device for easily and thoroughly cleaning vape coils for reuse and avoiding the need for frequent replacement. The device has a base enclosing a fan oriented to direct air upwardly, a heat block suspended above the fan, a heating element coupled to the heat block, and a shield coupled to the base and having a central opening. A cup is removably positioned in the central opening of the shield and in contact with the heat block to be heated thereby. A vape coil holder may removably suspended in the cup that the vape coil is submerged in a cleaning fluid in the cup. After the cup has been warmed to a predetermined temperature for a cleaning cycle, the cup may be removed and the vape coil holder suspended from the shield. The fan may then be operated for a predetermined time period for a drying cycle.

6 Claims, 10 Drawing Sheets

VAPE COIL CLEANING DEVICE

BACKGROUND OF THE INVENTION

1. Field of the Invention

The present invention relates to vaping devices and, more specifically, to a cleaner for removing debris from the electrical coil of a vaping device.

2. Description of the Related Art

Vaping or vape devices, often referred to as electronic cigarettes, are handheld battery-powered vaporizers that simulate smoking without the need for tobacco combustion. Vaping devices include a mouthpiece, a cartridge (liquid storage area), a heating element/atomizer referred to as a vape coil, a microprocessor, and a power source such as a battery. The vape coil is used to vaporize the liquid in the cartridge for inhalation. During use, however, the vape coil can become encrusted with residue from the vaporizing process. As a result, users are forced to discard the used coil and purchase replacement coils on a regular basis. Accordingly, there is a need in the art for an approach that can be used to clean vape coils, thereby extending their service life.

BRIEF SUMMARY OF THE INVENTION

The present invention provides an approach for easily and thoroughly cleaning vape coils for reuse, thereby delaying the need to purchase replacement. In an embodiment, the present invention is a vape cleaning device having a base enclosing a fan oriented to direct air upwardly, a heat block suspended above the fan, a heating element coupled to the heat block, and a shield coupled to the base and having a central opening. A cup is removably positioned in the central opening of the shield to be in contact with the heat block. A vape coil holder is removably suspended from the cup so that a portion of the holder extends within the cup. The device also includes a set of control electronics for selectively energizing the heating element to warm the heat block to a predetermined temperature and to selectively energize the fan. The shield is structured to suspend the vape coil holder in the central opening when the cup is removed from the central opening. The set of control electronics are configured to operate the heating element for a predetermined heating time period for a cleaning cycle. The set of control electronics are also configured to operate the fan for a predetermined drying time period for a drying cycle.

The present invention also includes a method of cleaning a vape coil. In a first step, vape coil cleaning device having a fan, a heat block, a shield with a central opening, and a cup removably positioned in the central opening of the shield and in contact with the heat block is provided. A vape coil is attached to a portion of a vape coil holder and a cleaning fluid is placed in the cup. The vape coil holder is suspended from the cup so that the portion of the vape coil holder is positioned in the cup and the vape coil is immersed in the cleaning fluid. The cup is then heated a heater attached to the heat block so that the cleaning fluid is heated to a predetermined temperature for a first predetermined time period. The vape coil holder from the cup after the conclusion of the first predetermined time period. The cup may then be removed from the shield and the vape coil holder suspended from the shield. Air may then be blow from the fan over the portion of the vape coil holder for a second predetermined time period to at least partially dry the vape coil. The step of heating the cup with a heater attached to the heat block may be triggered by a user depressing a first button to operate the heating element at a predetermined temperature for the first predetermined time period. The step of blowing air from the fan over the portion of the vape coil holder may be triggered by a user depressing a second button to operate the fan for the second predetermined time period.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
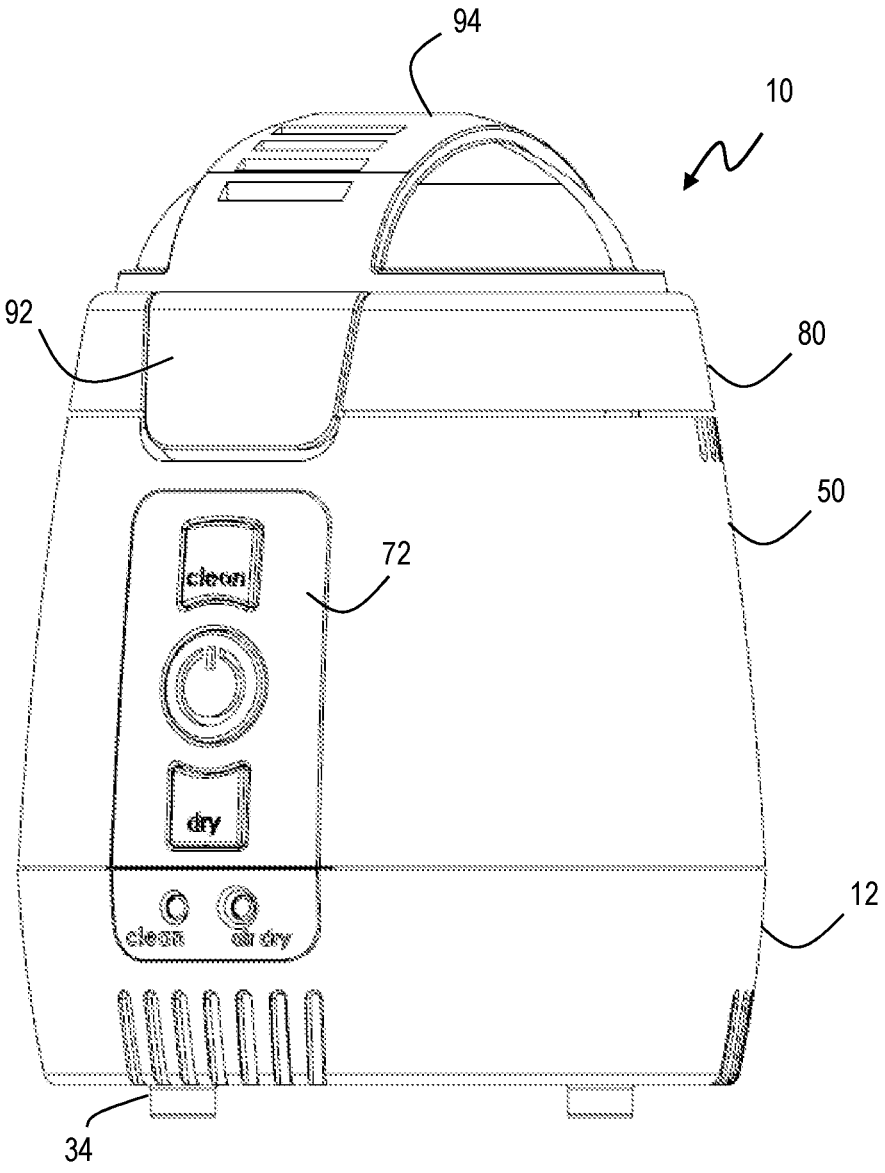
FIG. 1 is a perspective view of a vape coil cleaning device in a cleaning configuration according to the present invention.
Figure 2:
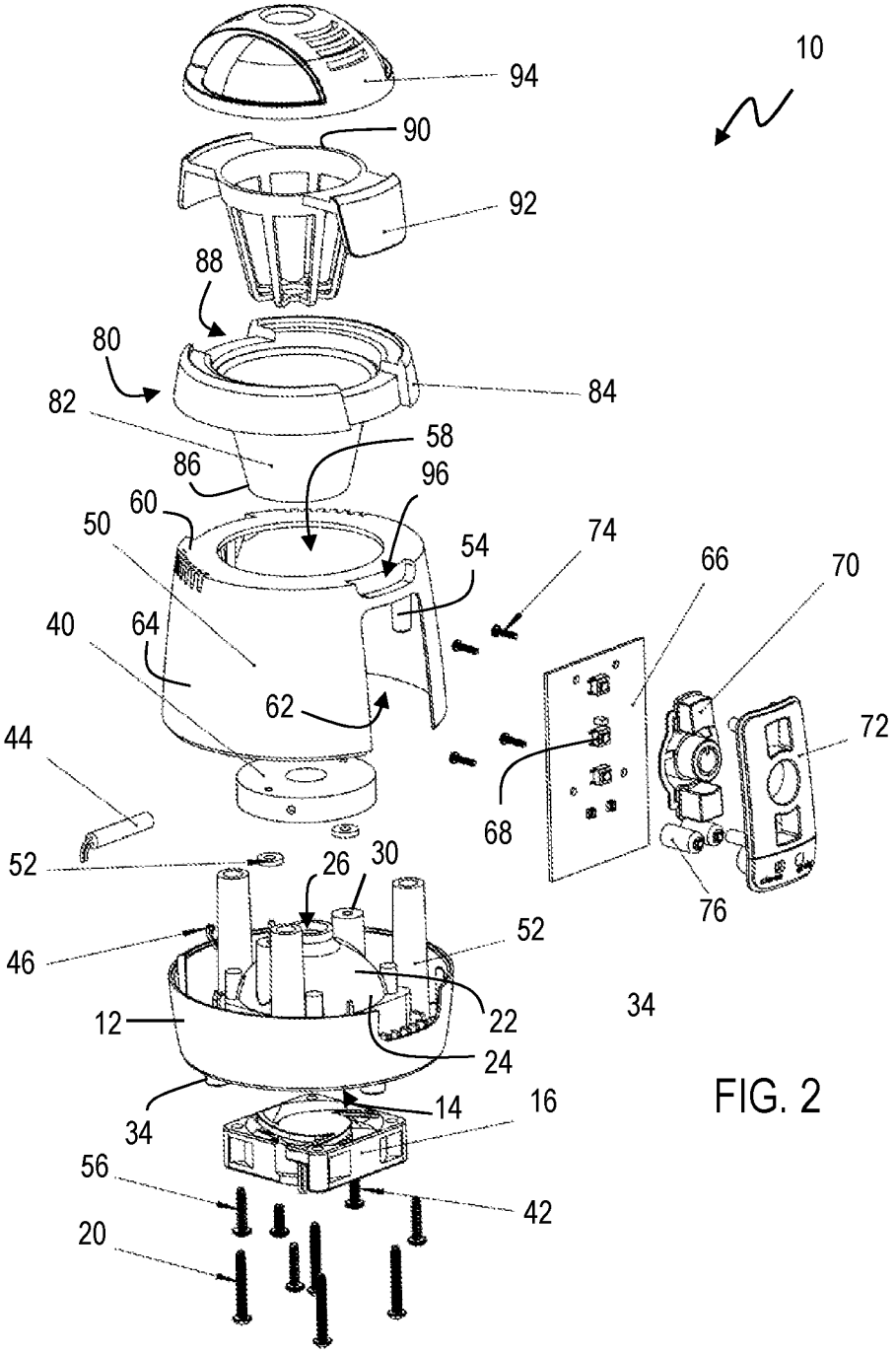
FIG. 2 is an exploded view of a vape coil cleaning device according to the present invention.
Figure 3:
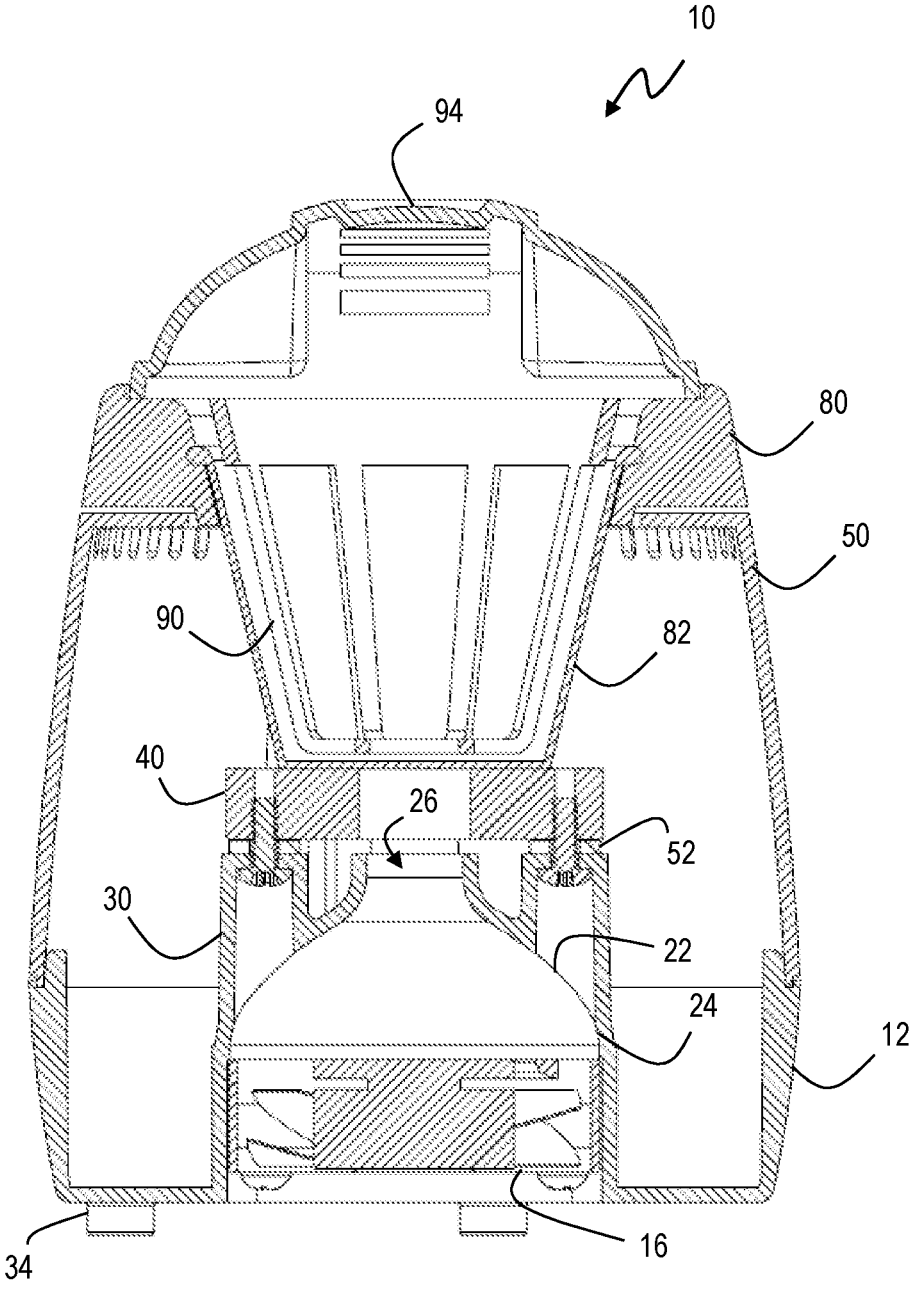
FIG. 3 is a first cross sectional view of a vape coil cleaning device according to the present invention.
Figure 4:
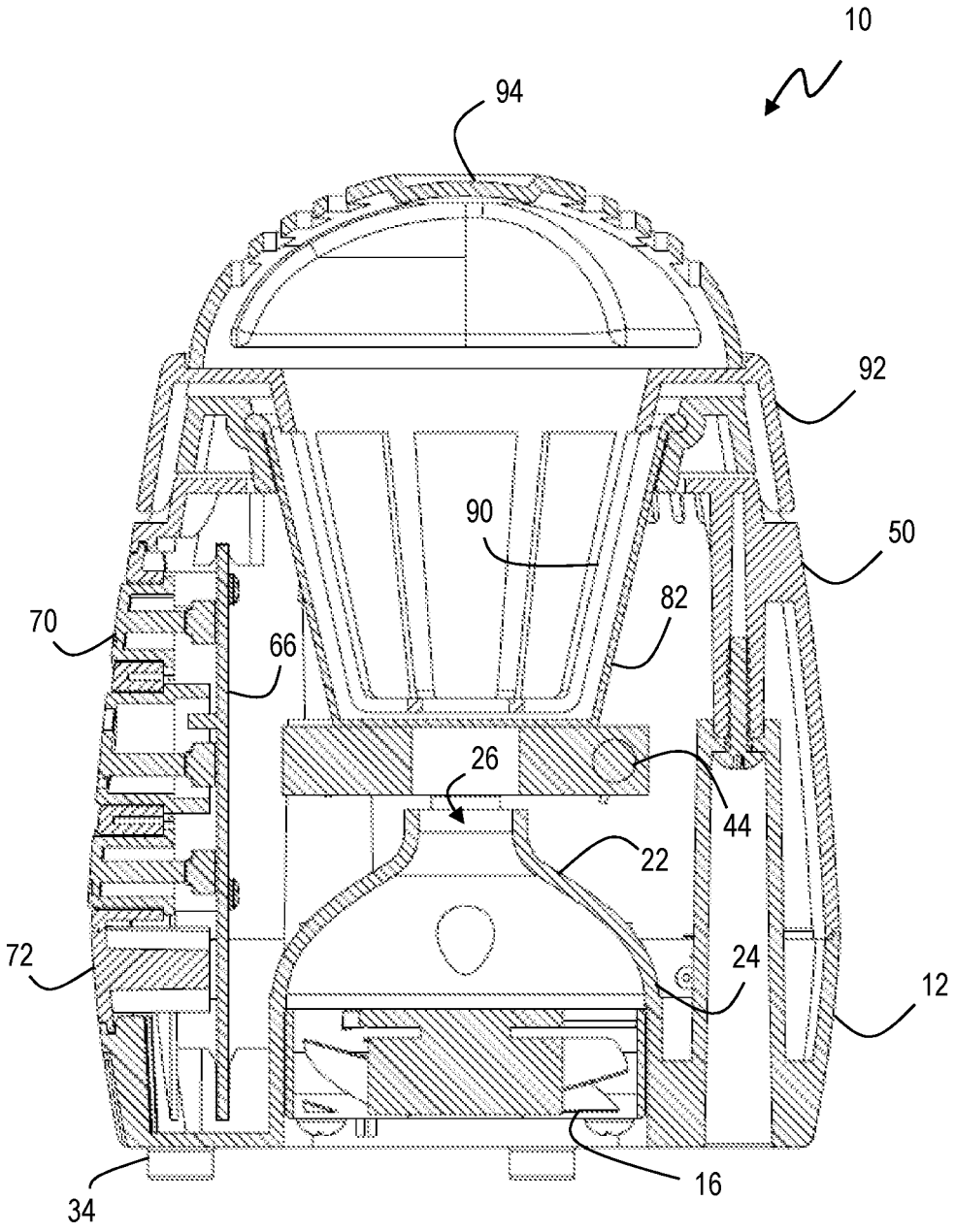
FIG. 4 is a second cross sectional view of a vape coil cleaning device according to the present invention.
Figure 5:
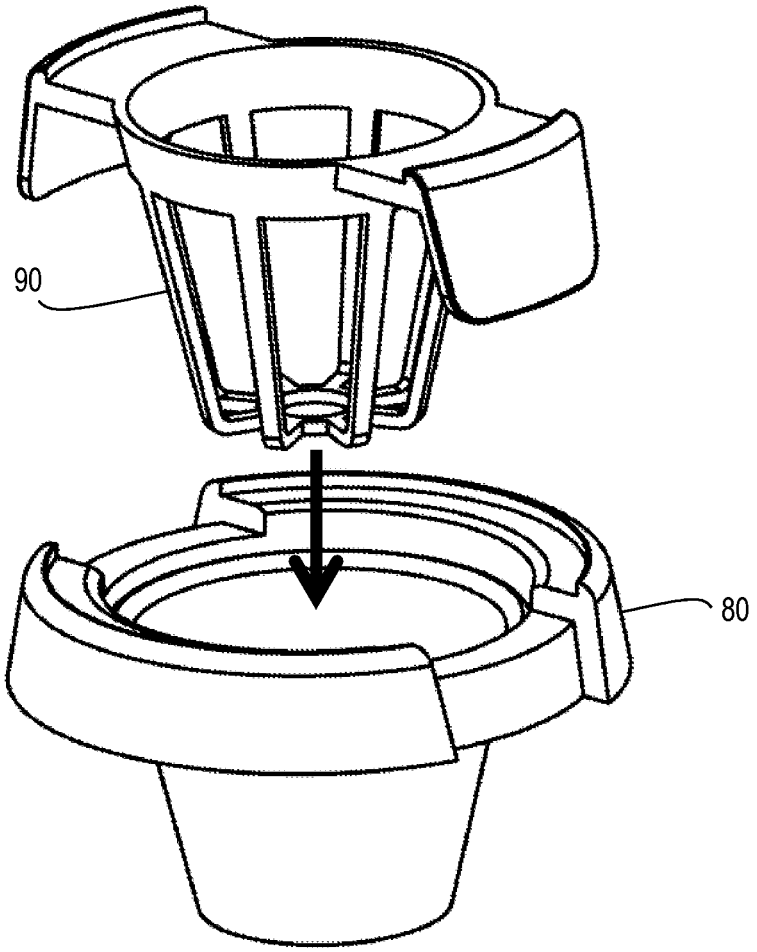
FIG. 5 is a perspective view of a vape coil holder for suspension within a cup according to the present invention.
Figure 6:
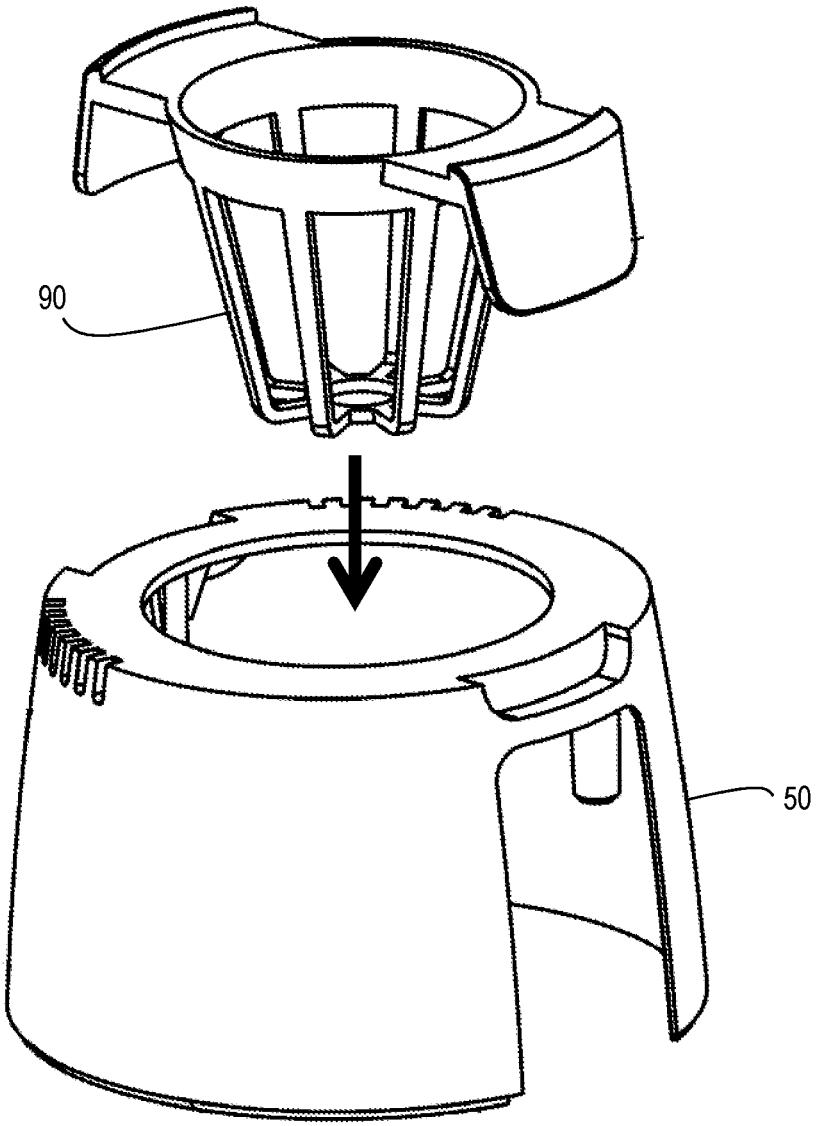
FIG. 6 is a perspective view of a vape coil holder for suspension within a shield according to the present invention.

Referring to the figures, wherein like numeral refer to like parts throughout, there is seen in FIG. 1 a vape coil cleaning device 10. Device 10 comprises a base 12 having a cavity 14 thereunder that is dimensioned to receive a fan 16. Fan 16 may include a grill and is attached to base 12 within cavity 14 via a series of screws 20. Fan 16 moves air from the outside environment into device 10 when fan 16 is operated.

Base 12 includes a dome 22 having a lower mouth 24 with a diameter that encloses fan 16 and is in fluid communication with an upper outlet 26 having a reduced diameter so that air driven by fan 16 is directed through upper outlet 26. A set of bosses 30 extend upwardly from base 14. A heat block 40 is attached to bosses 30 using screws 42 so that heat block 40 is suspended above outlet 26 of dome 22. Washers 52 are interposed between heat block and bosses 30 to prevent overheating of bosses 30, Base 12 may include feet 34 for supporting device 10. A cartridge heater 44 is mounted to heat block 40 to increase the temperature of heat block 40. A temperature sensor 46 is positioned along heat block 40 for determining the temperature of heat block 40.

A shield 50 is positioned over base 12 and coupled thereto via a set of upstanding bosses 52 of base 14 and corresponding downwardly extending pins 54 of shield 50. A series of screws are 56 inserted through bosses 52 to engage pins 54. Shield 50 includes a central opening 58 in its upper surface 60 that is aligned with and positioned over heat block 40. Shield 50 also includes a panel opening 62 along a side wall 64 thereof. A printed circuit board 66 containing control electronics 68 and a set of user buttons 70 are positioned inside shield 50 so that buttons 70 extend through panel opening 62. A face plate 72 is coupled to PCB 66 and buttons 70 to cover panel opening 62 using a series of screws 74. Face plate 72 also accepts the end of light tubes 76 that allow light emitting diodes (LEDs) forming part of control electronics 68 to serve as external user indicators of the state of device 10. Control electronics 68 are coupled to cartridge heater 44, temperature sensor 46, and fan 16 and are configured and programmed to selectively operate cartridge heater 44, temperature sensor 46, and fan 16 based on default settings.

A cup 80 having a frustroconical bowl 82 and a lip 84 extending radially outward from bowl 82 may be removably positioned in central opening 58. When positioned in central opening 58, the lower surface 86 of bowl 82 is in contact with heat block 40. As a result, when cartridge heater 44 is energized to warm heat block 40, bowl 82, and any contents therein, will be heated. Temperature sensor 44 provides temperature feedback to, among other things, prevent over heating of bowl 82. Upper lip 84, which may be formed by a rubber collar, defines two opposing gaps 88. A coil holder basket 90 may be selectively suspended in cup 80 by seating basket 90 in cup 80 so that a pair of opposing wings 92 are accepted into gaps 88 of lip 84. Wings 92 extend through gaps 88 to seat within a pair of notches 96 positioned about central opening 58 of shield 50. Basket 90 is configured to engage and hold an item to be cleaned, such as one of more vape coils (not shown). More specifically, when basket 90 is suspended from cup 80 by wings 92, any items in basket will be suspended within bowl 82 proximately to lower surface 86 without engaging lower surface 86. Basket 90 may also be suspended over central opening 58 by positioning wing 92 in notches 96 in the absence of bowl 82 so that any items held within basket 90 can be dried by device 10. A cover 94 may be positioned over basket 90.

Figure 7:
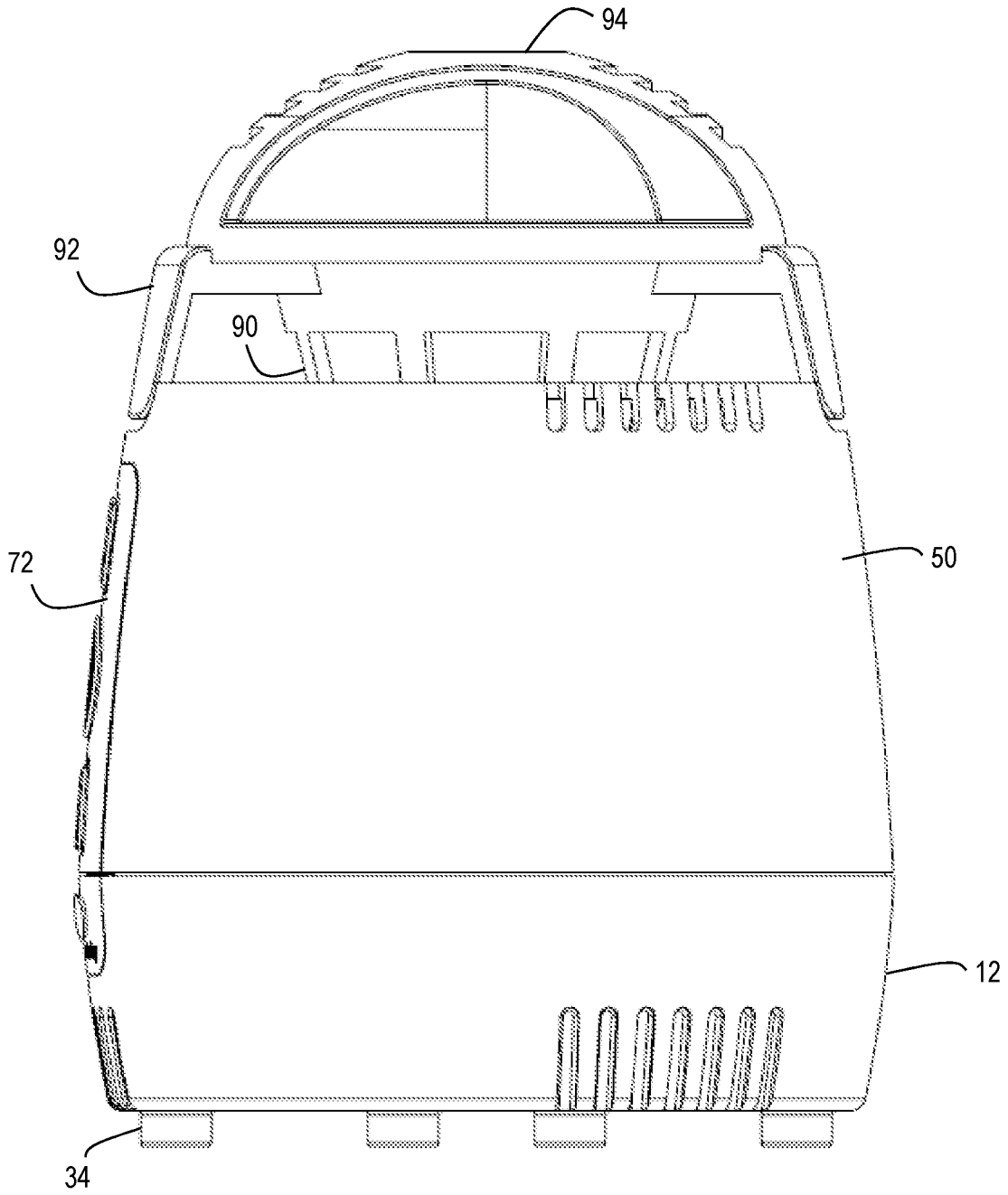
FIG. 7 is a perspective view of a vape coil holder in a drying configuration according to the present invention.

Device 10 may be used to clean vape coils, or any other item, by positioning the vape coils in basket 90. A cleaning fluid is placed in cup 80 and basket 90 seated in cup 80 using wings 92 and gaps 88 so that vape coils are submerged in the cleaning fluid. The cleaning fluid preferably comprises water, but may also comprise other generally recognized as save (GRAS) solvents, such as acetylsalicylic acid, ethyl alcohol, ethyl acetate, glycerol, glyceryl diacetate, and the like. When a user activates a cleaning cycle by pressing the appropriately designated button 70, cartridge heater 40 is energized to warm heat block 60 and thus the liquid in cup 80. Immersion of vape coils in heated liquid for a predetermined time period will clean the vape coils for reuse. After the end of the predetermined time period, vape coils may be removed by removing T-shaped coil holder 90. Acceptable time periods for the cleaning cycle may include a period of thirty minutes at a temperature of 40 degrees C. for as is known for ensuring that any bacteria are destroyed. A user may then remove cup 80 and suspend basket 90 from shield 50 only using notches 96, as seen in FIG. 7. The user may then activate a drying cycle by pressing the appropriately designated button 70, which activates fan 16 for a predetermined time period so that air is blown through upper outlet 26 and across vape coils suspended thereover by basket 90 so that the vape coils are dried and thus prepared for reuse in a vaping device. Acceptable time periods for the drying cycle may be thirty minutes. Heater 44 may optionally be activated during the drying cycle to warm the air provided by fan 16 and reduce drying time.

Figure 8:
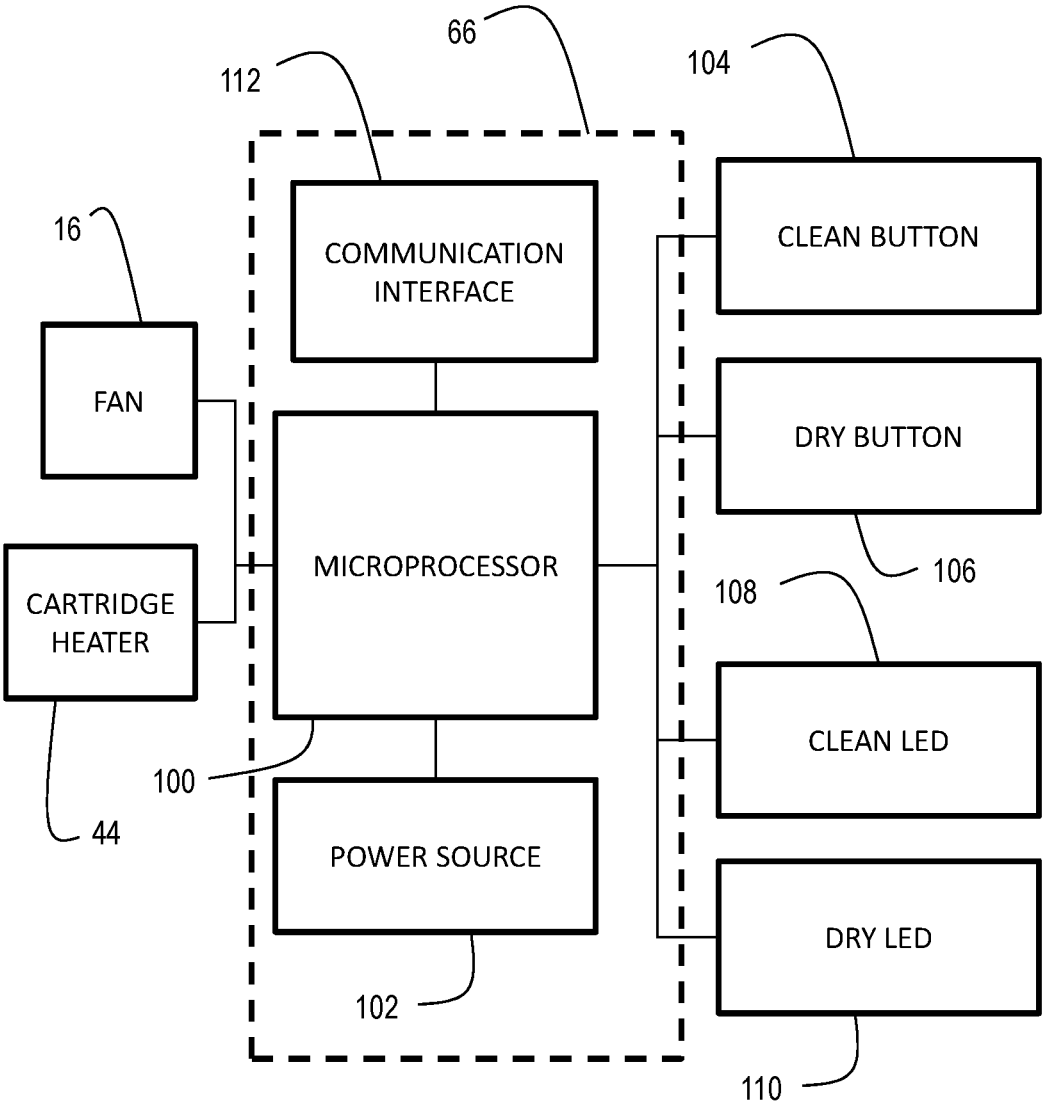
FIG. 8 is a schematic of the control electronics for a vape coil cleaning device according to the present invention.

Referring to FIG. 8, control electronics 66 may comprise a microprocessor 100 coupled to a power source 102 as well as user interface elements, such as a clean cycle button 104, and a dry cycle button 106. Microprocessor 100 may also be coupled to corresponding user indicators such as a clean cycle LED 108 and a dry cycle LED 110. Control electronics 66 may optionally include a communication interface 112 for reporting on the status of device 10 to external host, such as smartphone, tablet, or smart home hub.

Figure 9:
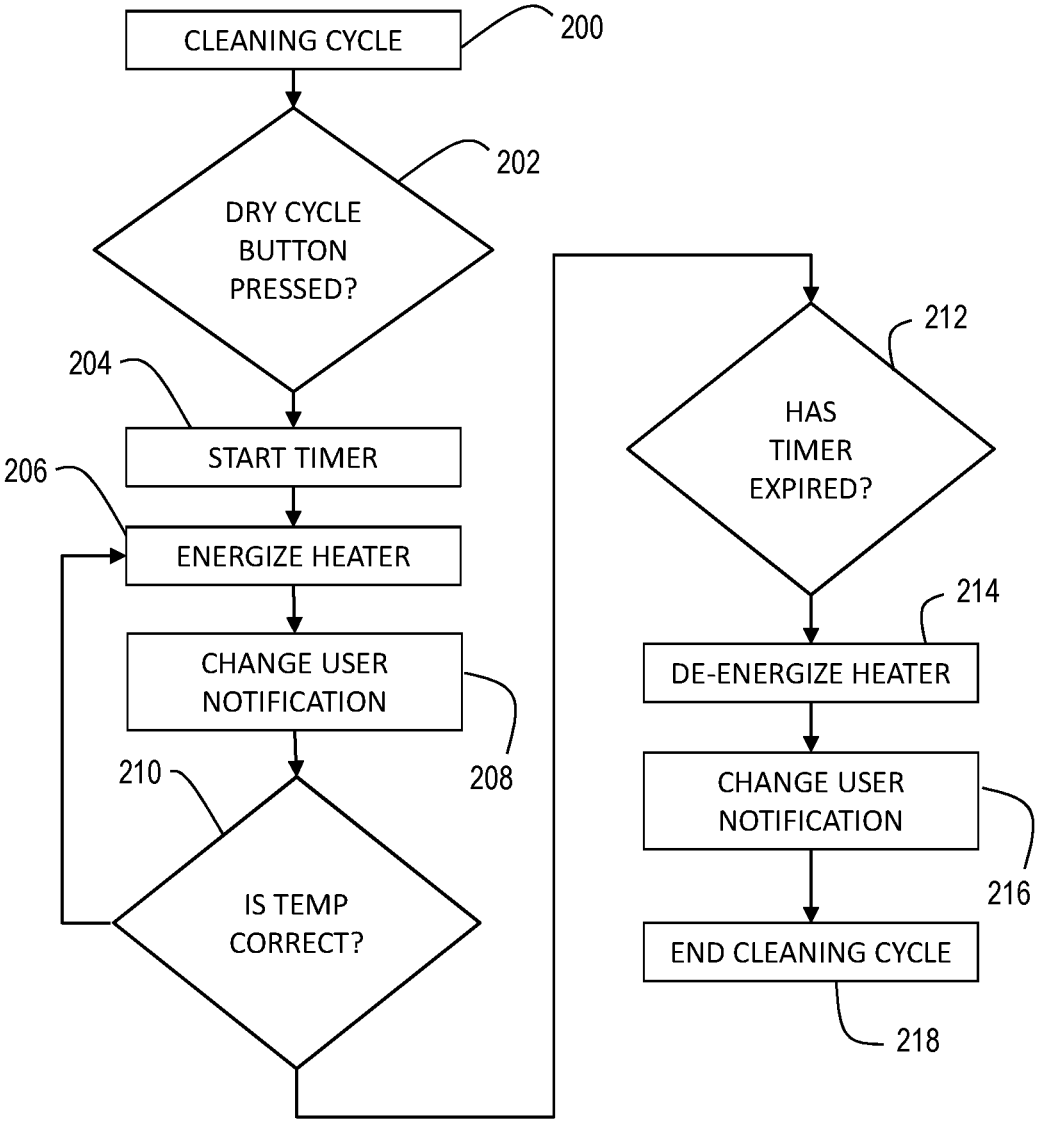
FIG. 9 is a schematic of a cleaning process according to the present invention.

Referring to FIG. 9, a method of controlling device 10 may include a cleaning cycle 200 that begins with a check 202 to determine whether a user has depressed a cleaning cycle button. If so, a timer 204 is started, heater is activated 206, a user indicator is changed 208, such as being illuminated, to reflect initiation of cleaning cycle 200. Next, temperature sensor 46 is checked 210 to maintain a predetermined temperature and prevent underheating or overheating. If a check 212 determines that timer 204 has expired, heater is de-energized 214, and user indicator is changed 216 to reflect the end of the cleaning cycle 218.

Figure 10:
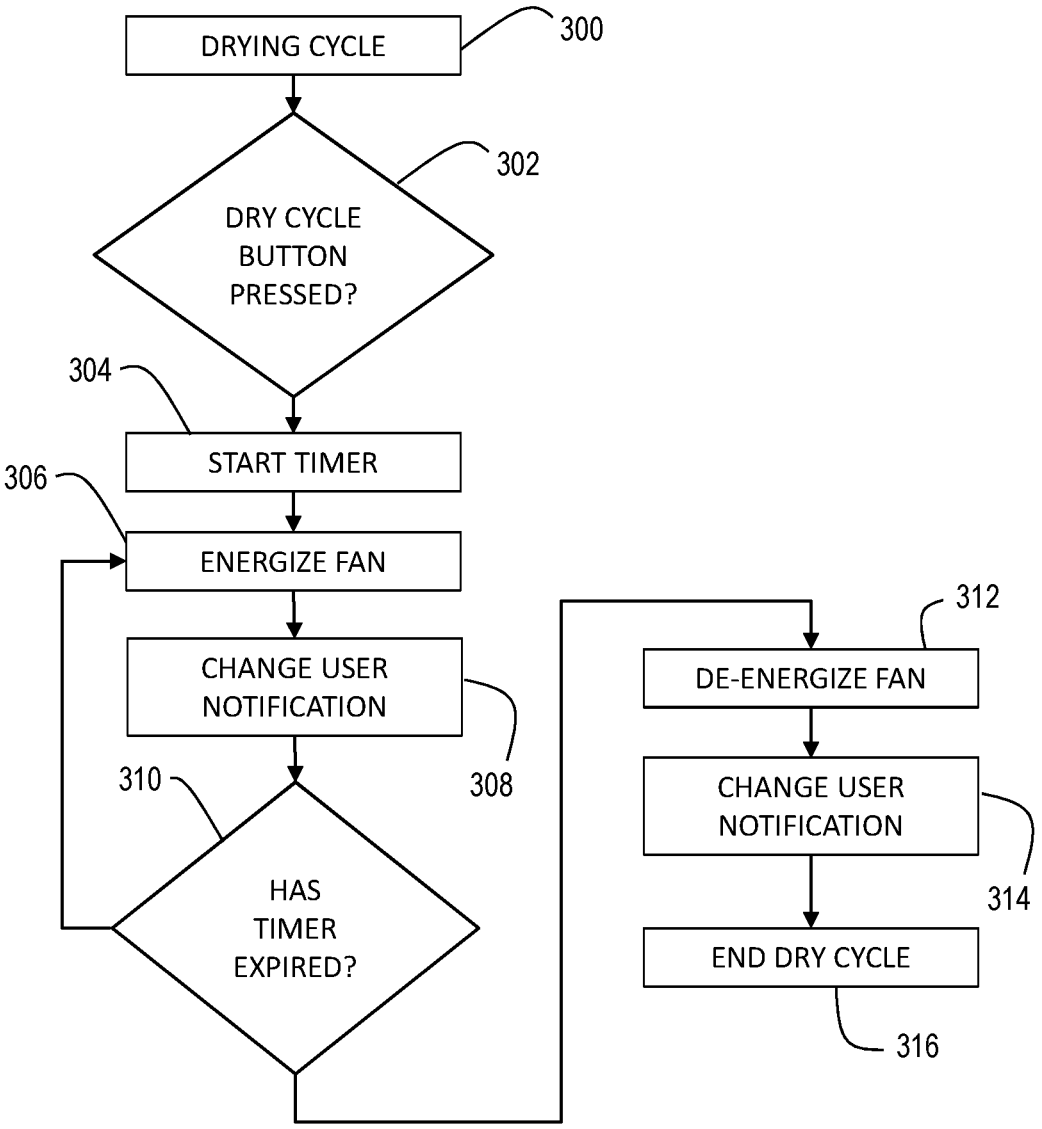
FIG. 10 is a schematic of a drying process according to the present invention.

Similarly, as seen in FIG. 10, a drying cycle 300 commences with a check 300 to determine whether a user has depressed a dry cycle button 302. If so, a timer is started 304, fan is operated 306, and user notification changed 308, e.g., a drying cycle LED is illuminated. If a check 310 determines that the time has expired, fan is turned off 312 and user notification is changed 314 to indicate the end of the drying cycle 316. As noted above, operation of fan 306 could also include energizing of the heater.

As described above, the present invention may be a system, a method, and/or a computer program associated therewith and is described herein with reference to flowcharts and block diagrams of methods and systems. The flowchart and block diagrams illustrate the architecture, functionality, and operation of possible implementations of systems, methods, and computer programs of the present invention. It should be understood that each block of the flowcharts and block diagrams can be implemented by computer readable program instructions in software, firmware, or dedicated analog or digital circuits.

What is claimed is:

1. A vape cleaning device, comprising:

a base enclosing a fan oriented to direct air upwardly;

a heat block suspended above the fan;

a heating element coupled to the heat block;

a shield coupled to the base and having a central opening;

a cup removably positioned in the central opening of the shield and in contact with the heat block; and a basket removably suspended from the cup so that a portion of the basket extends within the cup.

2. The device of claim 1, further comprising a set of control electronics for selectively energizing the heating element to warm the heat block to a predetermined temperature.

3. The device of claim 2, wherein the set of control electronics can selectively energize the fan.

4. The device of claim 3, wherein the shield is structured to suspend the basket in the central opening when the cup is removed from the central opening.

5. The device of claim 4, wherein the set of control electronics are configured to operate the heating element for a predetermined heating time period.

6. The device of claim 5, wherein the set of control electronics are configured to operate the fan for a predetermined drying time period.

* * * * *